United States Patent [19]

Turko et al.

[11] 4,338,962

[45] Jul. 13, 1982

[54] CONTROL AND RELIEF VALVES

[75] Inventors: John D. Turko; John D. Petro, both of Hubbard, Ohio

[73] Assignee: Commercial Shearing, Inc., Youngstown, Ohio

[21] Appl. No.: 177,928

[22] Filed: Aug. 13, 1980

[51] Int. Cl.[3] ..... F15B 13/04

[52] U.S. Cl. ..... 137/269; 91/452; 137/881

[58] Field of Search ..... 91/449, 452; 137/269, 137/881

[56] References Cited

U.S. PATENT DOCUMENTS 2,538,928 1/1951 Wood ..... 91/449 X 2,679,263 5/1954 Kiser ..... 251/297 X

*Primary Examiner*—Gerald A. Michalsky

*Attorney, Agent, or Firm*—Buell, Blenko, Ziesenheim & Beck

[57] ABSTRACT

A pump control valve and relief valve assembly are provided in the form of a valve housing having a main bore therethrough, a spool movable in said bore and having a pair of spaced annular grooves therein, a spaced relief bore in said housing, a pump chamber and a work chamber in said housing intersecting both bores, a pair of tank chambers, one on each opposite side of the pump and work chambers intersecting said main bore, said tank chamber adjacent the work chamber intersecting the relief bore, a tank bore connecting said tank chambers, an inlet return bore intersecting said tank chamber adjacent the work chamber, an inlet port connected to said relief bore and jump chamber and adapted to connect to a pump outlet port, a tank port connected to said tank bore, a pump inlet port and a return port connected to said inlet return bore, said pump inlet port adapted to connect to a pump inlet port and the return port adapted to be connected to a source of return fluid, and a combination check and relief valve assembly in the relief bore at the cylinder chamber acting as a check between the inlet port and work chamber and relieving excess pressure from said work chamber to said adjacent tank chamber.

6 Claims, 8 Drawing Figures

CONTROL AND RELIEF VALVES

This invention relates to control and relief valves particularly to internal relief valves for protecting both the pump and cylinder or other working element.

The pump and working element or elements of any hydraulic system are subject to overloads which require that the excess pressure be promptly vented in order to protect the overload portion of the system from damage. This is generally accomplished by the use of relief valves placed in the system to vent off the fluid under excess pressure and return it to a low pressure portion of the system such as the reservoir. This usually requires the insertion of both the relief valves and a return system for the vented hydraulic fluid.

We have invented a relief valve forming an internal component of a control valve adapted for use as a unit with a hydraulic pump, between the pump and the working element such as a cylinder. This structure eliminates the need for any external pipe and yet can satisfactorily relieve excess pressure both on the pump and on the cylinder. Our description of the invention will use a cylinder as the working element since it is the most common working element in use. The relief valve of our invention will protect the pump from excessive pressure when the control valve is in the raise position and will protect the cylinder, with the spool in the neutral or hold position, against shock loads encountered in travel from one place to another under load. The apparatus can be part of either a two or three line system.

We provide a valve housing a main or working bore therethrough, a spool movable in said bore and having a pair of spaced annular grooves therein, a spaced relief bore in said housing, a pump chamber and a cylinder or work chamber in said housing intersecting both bores, a pair of tank chambers on opposite sides of the pump and cylinder chambers intersecting said working bore, one of said tank chambers, preferably the one adjacent the cylinder chamber, intersecting the relief bore, a tank bore connecting said tank chambers, an inlet return bore intersecting said one of said tank chambers, a work port connected to said cylinder chamber, an inlet port connected to said relief bore and pump chamber, a tank port connected to said tank bore, a pump inlet port and a return port connected to said inlet return bore and a combination check and relief valve assembly in the relief bore at the cylinder chamber acting as a check between the inlet and the cylinder chamber and relieving excess pressure from the cylinder chamber to the said air tank chamber whereby excess pressure in the cylinder chamber from one of the pumps and cylinder is relieved into the said one tank chamber. The valve may be made to operate as a two line valve by plugging the tank port or as a three line valve by connecting with tank port with a reservoir. Preferably the valve structure is attached to a pump with the inlet directly connected to the pump outlet or discharge. The inlet return port and pump inlet port are preferably at opposite ends of the inlet return bore.

In the foregoing general description, we have set out certain objects, purposes and advantages of our invention. Other objects, purposes and advantages of this invention will be apparent from a consideration of the following description and the accompanying drawings in which.

Figure 7:
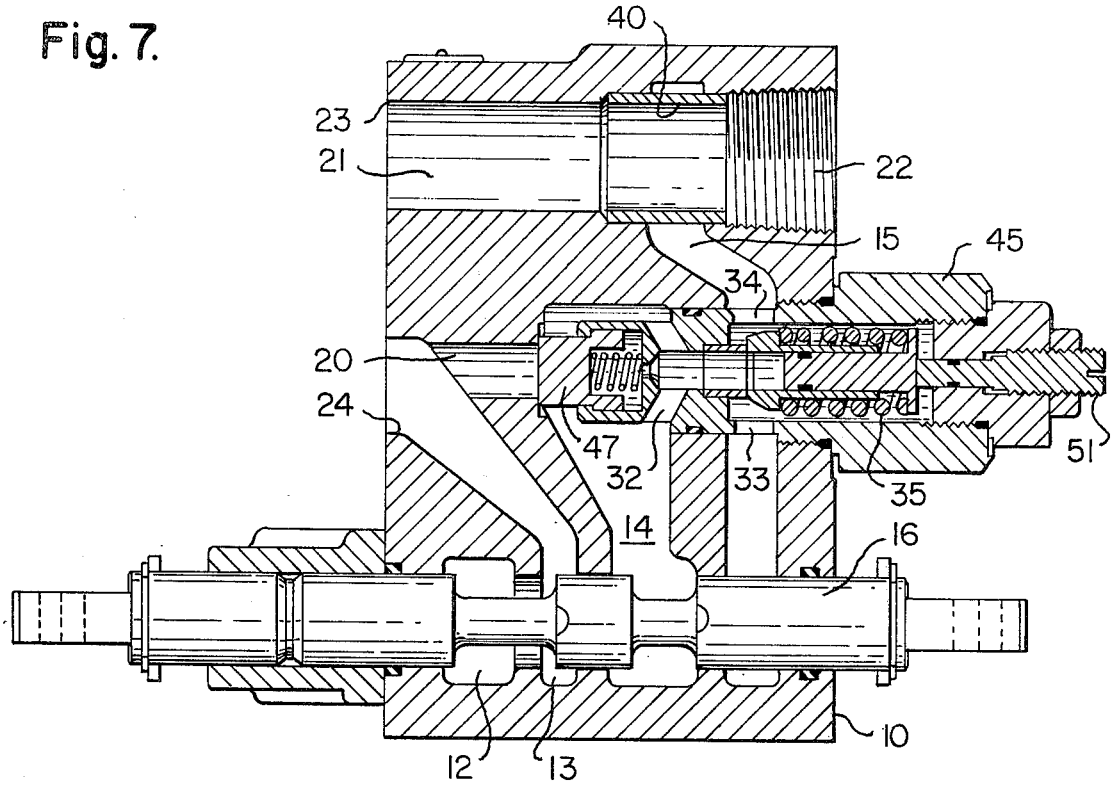
FIG. 7 is a vertical section through the valve of FIG. 1 arranged for three line operation.
Figure 8:
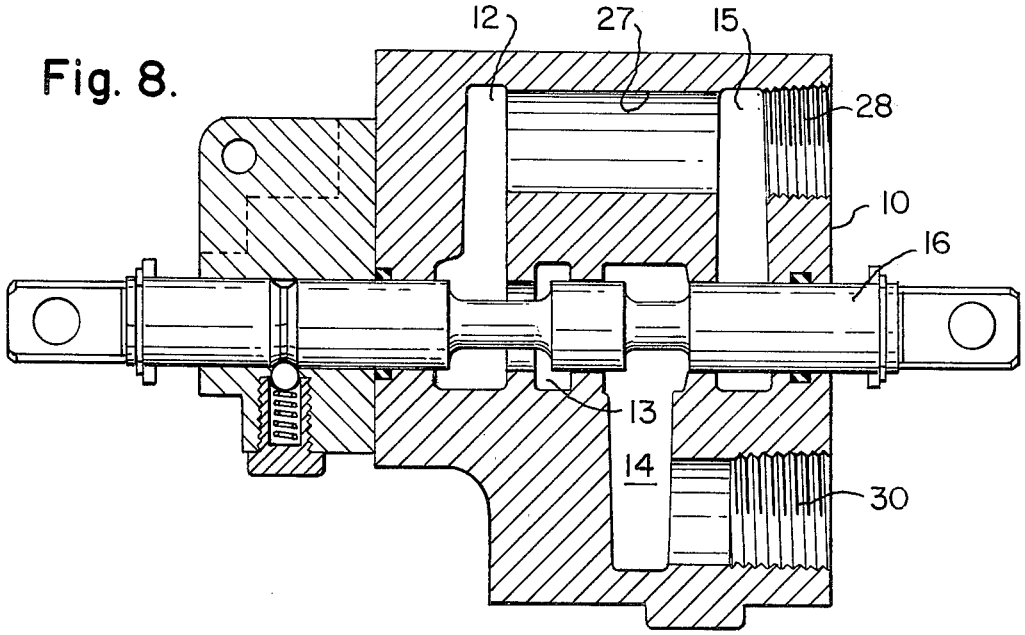
FIG. 8 is a section transverse to the section of FIG. 7.

Referring to the drawings we have illustrated a housing 10 having a main bore 11 therein intersected by, successively, a tank chamber 12, a pump chamber 13, a cylinder chamber 14 and a second tank chamber 15. A spool 16 is movable axially of said main bore 11 and is provided with a pair of annular grooves 17 and 18 intermediate its ends, the first of which, 17, connects tank chamber 12 and pump chamber 13 in the neutral position and the second of which, 18, isolates the cylinder chamber in the neutral position. Pump chamber 13, cylinder chamber 14 and tank chamber 15 are intersected by a relief bore 20 generally parallel to the main bore 11. Tank chamber 15 is also intersected by inlet return bore 21 having a return port 22 at one end which is connected to a work cylinder at one end and a pump inlet port 23 at the other end which inlet port is connected, to a pump inlet. Relief bore 20 is provided with the inlet port 24 which connects with the outlet port of the pump. The opposite end of relief bore 20 is provided with a combination relief valve 34 and check valve 47. The housing 10 also carries a tank bore 27 generally parallel to and to one side of the main bore 11. Tank bore 27 intersects a portion of the two tank chambers 12 and 15 and is provided with an outlet port 28 which may be closed by a pipe plug 29 to form a two line system (FIGS. 1–6) or it may be connected to a reservoir forming a three line system (FIGS. 7 & 8). The cylinder bore is provided with a cylinder port 30 through which it can be connected to a cylinder or other hydraulically operated device.

The combination check and relief valve is made up of a cylindrical housing 45 adapted to be threaded into an enlarged portion of relief bore 20 to a point adjacent the inlet **20*a* of bore 20 into work chamber 14. Housing 45 is provided at its inner end with a cylindrical recess 46 carrying a cylindrical valve element 47 axially movable therein and normally urged into closing check contact with inlet 20*a* by spring 48. An internal flange 49 at the opening of recess 46 cooperates with a peripheral shoulder 50 on valve element 47 to retain the valve element against ejection from recess 46. An axial passage 31 extends through housing 45 from a point spaced from recess 46 to the exterior of the housing. Radial passages 32 connect passage 31 with work chamber 14. Radial passages 33 connect passage 31 with tank chamber 15. Relief valve 34 closes passage 31 between radial passages 32 and 33 and is spring loaded by spring 35 which is adjustable to provide a variable load by means of screw 51**.

Figure 1:
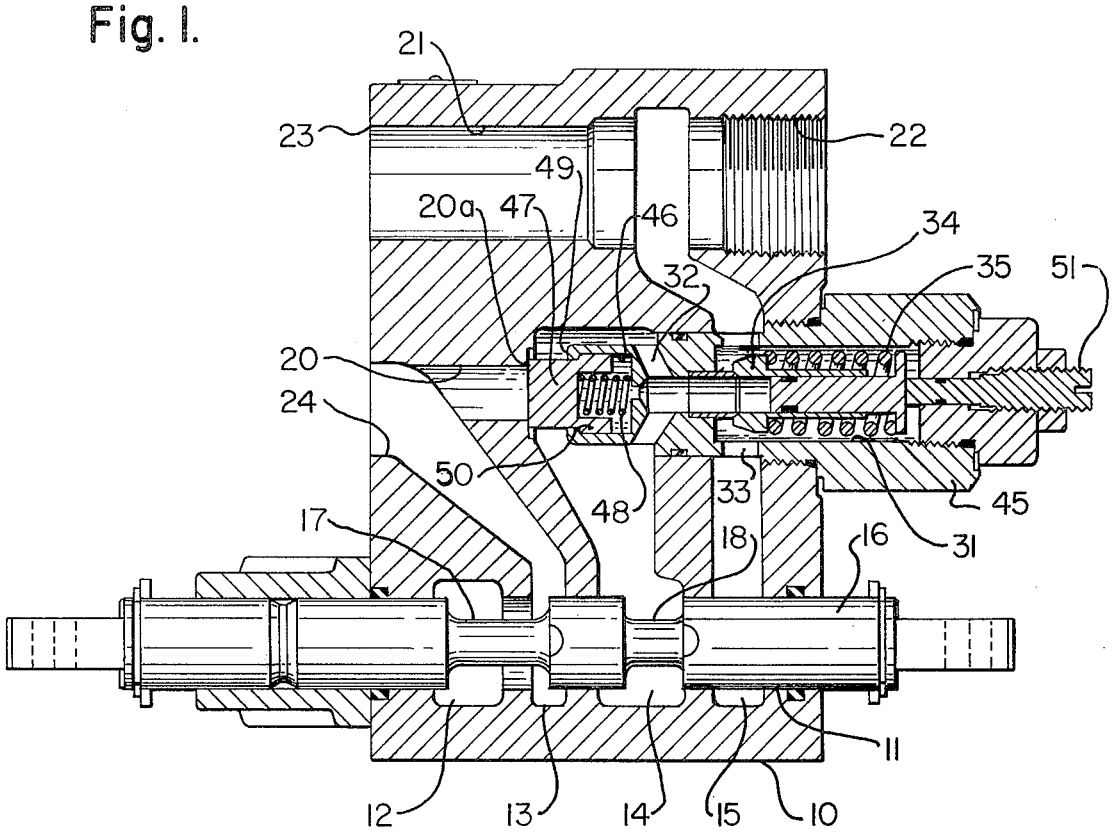
FIG. 1 is a vertical section through a valve assembly according to this invention in the neutral position for two line operation.
Figure 2:
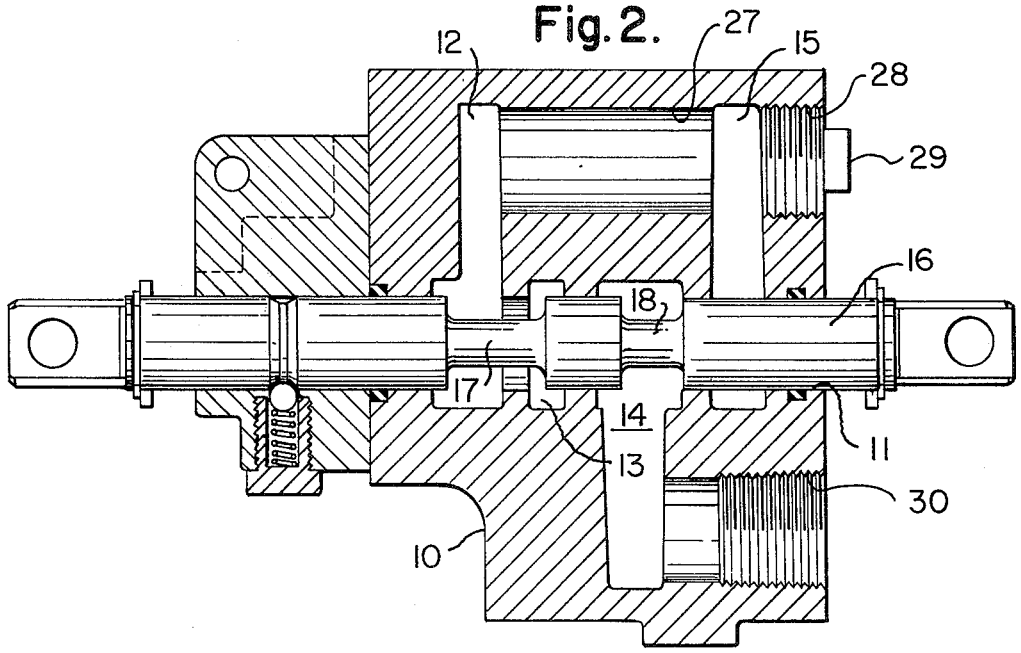
FIG. 2 is a section transverse to the section of FIG. 1 through the main bore in the neutral position.
Figure 3:
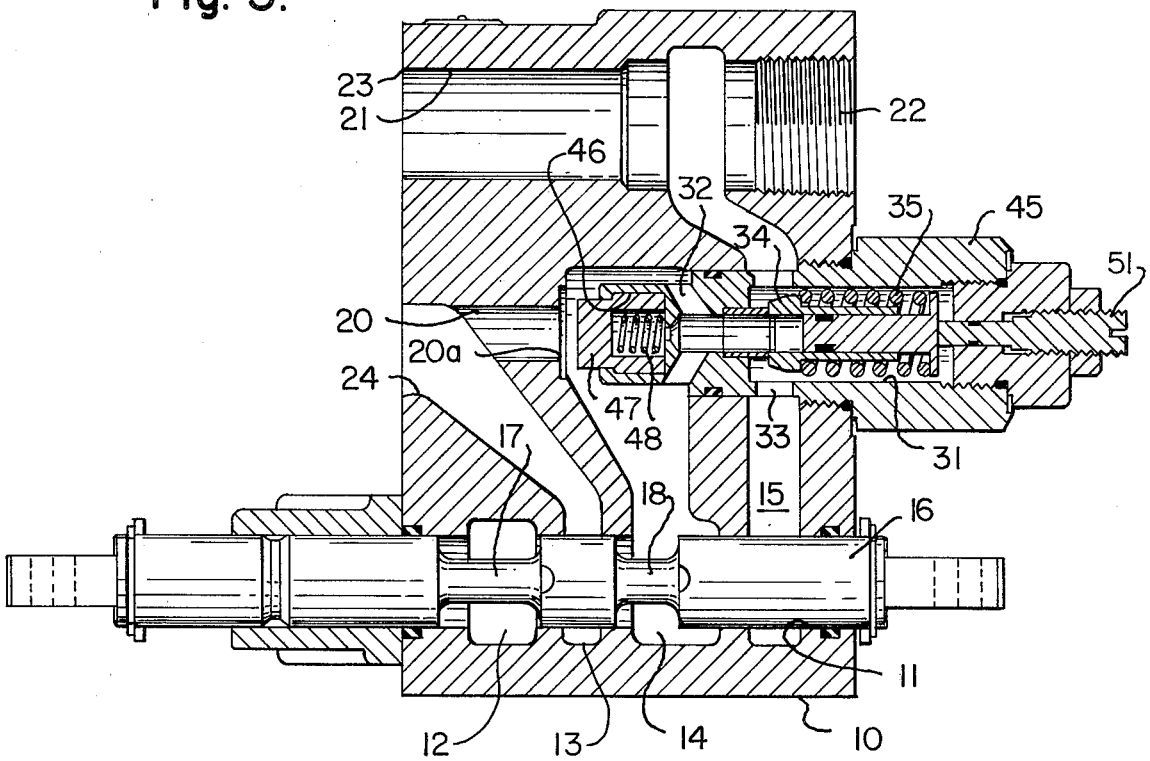
FIG. 3 is a vertical section through the valve assembly of FIG. 1 in the raise or work position for two line operation.
Figure 4:
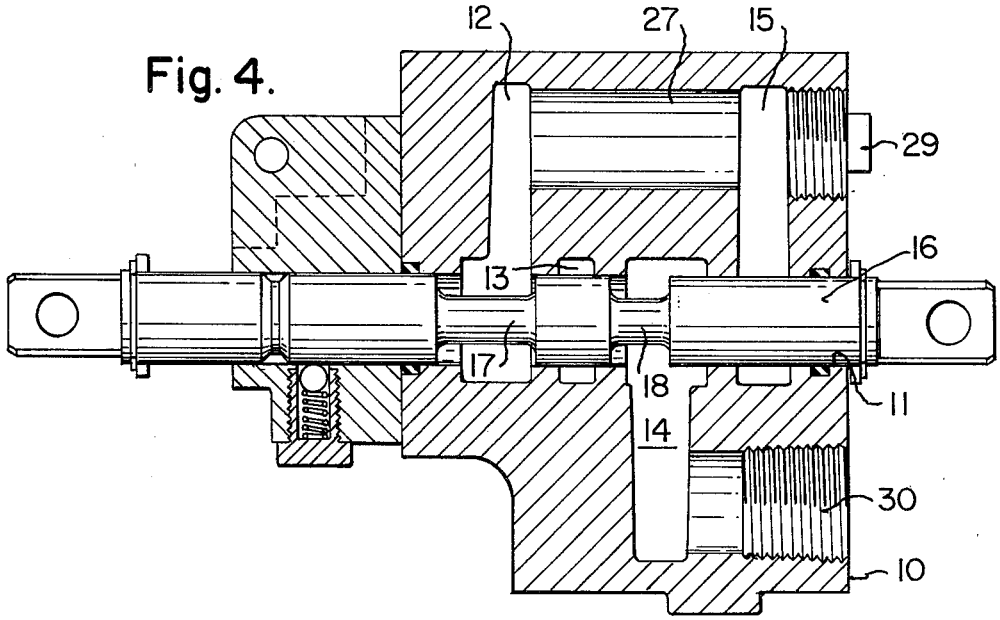
FIG. 4 is a section transverse to the section of FIG. 1 through the bore in the raise or work position.

In operation, the valve will operate to relieve pressure in cylinder chamber 14 in the neutral position of spool 16 if the cylinder line becomes overloaded by moving relief valve to the right viewing FIG. 1 against spring 35*a* to discharge fluid from chamber 14 to chamber 15 and into inlet return bore 21 where it can pass through port 22 to the opposite side of the cylinder. Where it is desired to operate the work cylinder the spool 16 is moved to the left (Viewing FIG. 2) blocking the passage from pump chamber 13 to tank chamber 12. This forces fluid through check valve 47 into chamber 14 and out port 30 to the work cylinder (FIG. 4). In the event of an overload in this work position and the consequent overloading of the pump, the relief valve 34 will move to the right by-passing a part of the fluid from the pump to the tank chamber 15 and thence back to the pump inlet.

Figure 5:
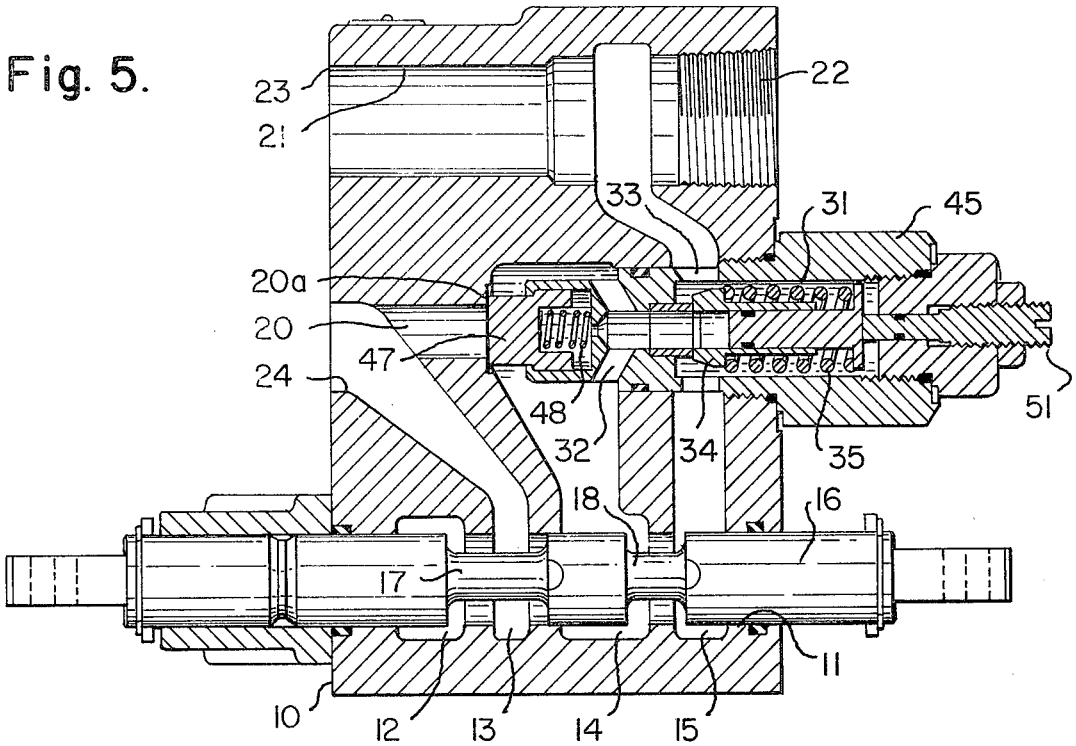
FIG. 5 is a vertical section through the valve assembly of FIG. 1 in the lower position for two line operations.
Figure 6:
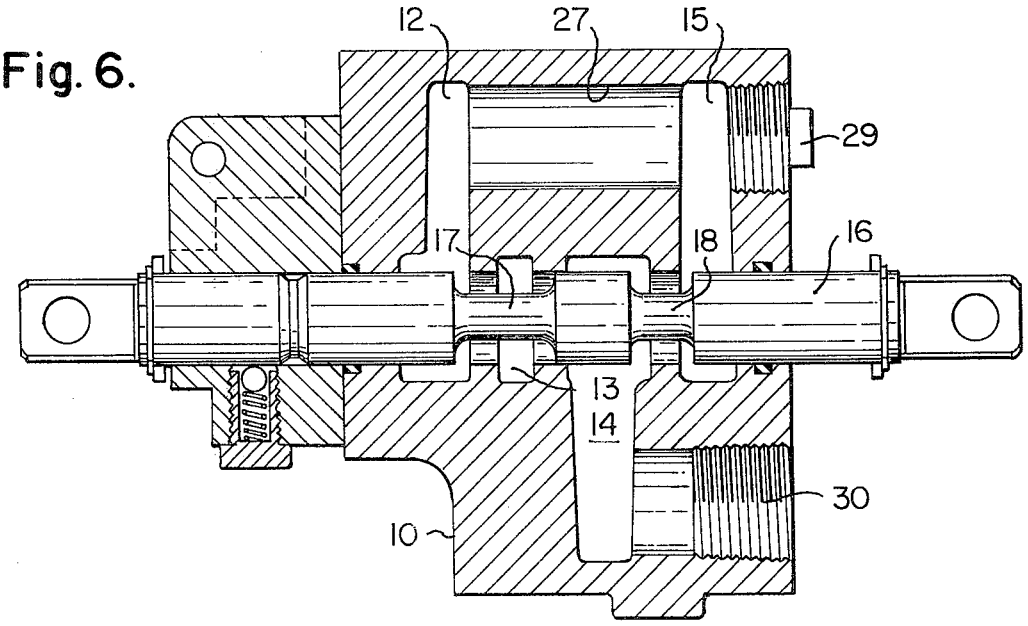
FIG. 6 is a transverse section through the valve assembly of FIG. 1 at the valve in the lower position.

FIGS. 5 and 6 illustrate the relative positions of the spool in the lower position for the cylinder.

FIGS. 7 and 8 illustrate the arrangement of the valve for a three line system in which the tank bore 27 is connected through outlet port 28 to a reservoir (not shown) and the return port 22 is also connected to reservoir and blocked from tank chamber 15 by a sleeve 40 inserted into bore 21.

In the foregoing specification we have set out certain preferred practices and embodiments of our invention, however it will be understood that this invention may be otherwise embodied within the scope of the following claims.

We claim:

1. A pump control valve and relief assembly comprising a valve housing having a main bore therethrough, a spool movable in said bore and having a pair of spaced annular grooves therein, a spaced relief bore in said housing, a pump chamber and a work chamber in said housing intersecting both bores, a pair of tank chambers, one on each opposite side of the pump and work chambers intersecting said main bore, said tank chamber adjacent the work chamber intersecting the relief bore, a tank bore connecting said tank chambers, an inlet return bore intersecting said tank chamber adjacent the work chamber, an inlet port connected to said relief bore and pump chamber and adapted to connect to a pump outlet port, a tank port connected to said tank bore, a pump inlet port and a return port connected to said inlet return bore, said pump inlet port adapted to connect to a pump inlet port and the return port adapted to be connected to a source of return fluid, and a combination check and relief valve assembly in the relief bore at the cylinder chamber acting as a check between the inlet port and work chamber and relieving excess pressure from said work chamber to said adjacent tank chamber.

2. A valve structure as claimed in claim 1 wherein the combination check and relief valve has a spring loaded check valve normally closing the relief bore between the inlet port and work chamber and a spring loaded relief valve normally closing the relief bore between the work chamber and adjacent tank chamber.

3. A structure as claimed in claim 1 wherein the pump inlet port and return port are at opposite ends of said inlet return bore.

4. A structure as claimed in claim 1 for two line operation wherein a removable plug is inserted in the tank port.

5. A structure as claimed in claim 1 for three line operation wherein a sealing sleeve is inserted in the inlet return bore at its intersection with the tank chamber closing said bore against communication with the tank chamber.

6. A valve structure as claimed in claim 1 or 2 or 3 or 4 or 5 wherein the combination check and relief valve comprises an elongate cylindrical housing threadingly engaged in the end of the relief bore opposite the inlet port and extending through the tank chamber adjacent said end of the relief bore and into the work chamber in sealing engagement with the housing between the work chamber and tank chamber, a spring loaded valve member axially movable in the end of said housing to abut and normally close the relief bore between the inlet port and work chamber, passage means in said elongate housing communicating from the work chamber to the tank chamber and spring loaded relief valve means in said passage means normally closing the same against passage of fluid and opening upon being pressurized by fluid from the work chamber above a selected point.

* * * * *

UNITED STATES PATENT AND TRADEMARK OFFICE

CERTIFICATE OF CORRECTION

PATENT NO. : 4,338,962

DATED : July 13, 1982

INVENTOR(S) : JOHN D. TURKO and JOHN D. PETRO

It is certified that error appears in the above-identified patent and that said Letters Patent are hereby corrected as shown below:

On the title page

In the Abstract, line 13, "jump chamber" should read --pump chamber--.

Column 1, line 33, after "housing" insert --having--.

Signed and Sealed this

*Fourteenth* Day of *September 1982*

[SEAL]

*Attest:*

GERALD J. MOSSINGHOFF

*Attesting Officer* *Commissioner of Patents and Trademarks*